US008695696B2

(12) United States Patent
Shoyhetman et al.

(10) Patent No.: US 8,695,696 B2
(45) Date of Patent: Apr. 15, 2014

(54) JAR WITH IMPROVED VALVE

(75) Inventors: Michael Shoyhetman, Alberta (CA); David Budney, Edmonton (CA); Craig Budney, Edmonton (CA); Glenn Budney, Edmonton (CA)

(73) Assignee: Lee Oilfield Services Ltd., Edmonton, Alberta (CA)

( * ) Notice: Subject to any disclaimer, the term of this patent is extended or adjusted under 35 U.S.C. 154(b) by 480 days.

(21) Appl. No.: 12/840,954

(22) Filed: Jul. 21, 2010

(65) Prior Publication Data

US 2012/0018144 A1 Jan. 26, 2012

(51) Int. Cl.
*E21B 31/113* (2006.01)
*E21B 31/107* (2006.01)

(52) U.S. Cl.
USPC ..... 166/178; 175/297

(58) Field of Classification Search
USPC ..... 166/178, 301; 175/302, 296, 297, 300
See application file for complete search history.

(56) References Cited

U.S. PATENT DOCUMENTS

| | | | | |
|---|---|---|---|---|
| 5,007,479 | A * | 4/1991 | Pleasants et al. | 166/178 |
| 5,086,853 | A | 2/1992 | Evans | |
| 5,123,493 | A | 6/1992 | Wenzel | |
| 5,174,393 | A | 12/1992 | Roberts et al. | |
| 5,232,060 | A | 8/1993 | Evans | |
| 5,411,107 | A | 5/1995 | Hailey et al. | |
| 5,447,196 | A | 9/1995 | Roberts | |
| 5,495,902 | A | 3/1996 | Hailey et al. | |
| 5,595,244 | A | 1/1997 | Roberts | |
| 5,595,253 | A | 1/1997 | Martin et al. | |
| 5,647,446 | A | 7/1997 | Wenzel | |
| 5,906,239 | A | 5/1999 | Oettli | |
| 5,931,242 | A | 8/1999 | Oettli | |
| 5,984,028 | A | 11/1999 | Wilson | |
| 6,135,217 | A | 10/2000 | Wilson | |
| 6,202,767 | B1 | 3/2001 | Friis | |
| 6,290,004 | B1 | 9/2001 | Evans | |
| 6,349,767 | B2 | 2/2002 | Gissler | |
| 6,948,560 | B2 | 9/2005 | Marsh | |
| 7,293,614 | B2 | 11/2007 | Rose | |
| 7,299,872 | B2 | 11/2007 | Darnell | |
| 8,151,910 | B2 * | 4/2012 | Swinford | 175/297 |
| 2009/0301707 | A1 | 12/2009 | Budney et al. | |
| 2010/0307739 | A1 | 12/2010 | Shoyhetman et al. | |

FOREIGN PATENT DOCUMENTS

| | | |
|---|---|---|
| CA | 2072851 | 1/1992 |
| CA | 2113458 | 3/1993 |
| CA | 2105930 | 2/1995 |
| CA | 2179594 | 1/1997 |

* cited by examiner

*Primary Examiner* — Jennifer H Gay
*Assistant Examiner* — Wei Wang
(74) *Attorney, Agent, or Firm* — Frank J. Dykas; Dykas & Shaver

(57) ABSTRACT

A jar comprises an outer housing; an inner mandrel within the outer housing to define a fluid chamber; a valve disposed within the fluid chamber with a restriction surface facing, during setting, a cooperating restriction surface on the outer housing and a pressure surface facing the inner mandrel, the valve movable between a seated position and an unseated position; the cooperating restriction surface cooperating with the restriction surface to set the jar for a jar in a first direction; the pressure surface being exposed to fluid within the fluid chamber when the jar is set and pressuring up for a jar in the first direction; the pressure surface being indented to cause uneven radial movement, in a plane perpendicular to a jar axis, of the restriction surface towards the cooperating restriction surface when the jar is set and pressuring up for a jar in the first direction; and jarring surfaces.

11 Claims, 8 Drawing Sheets

Fig. 1
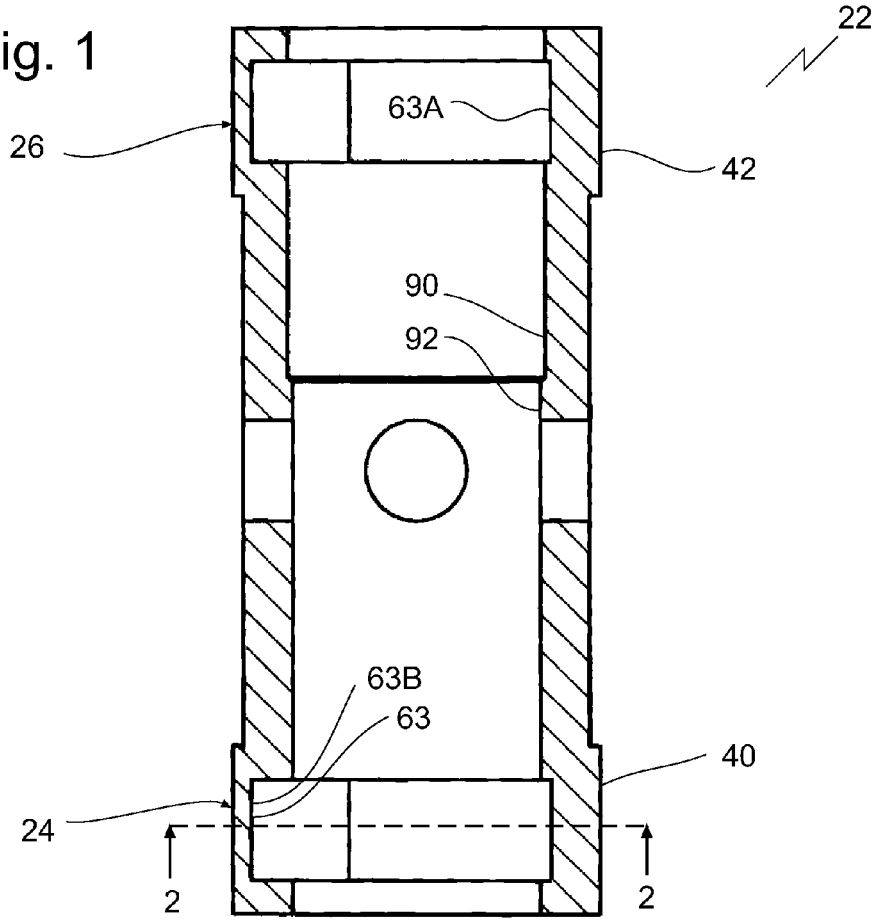
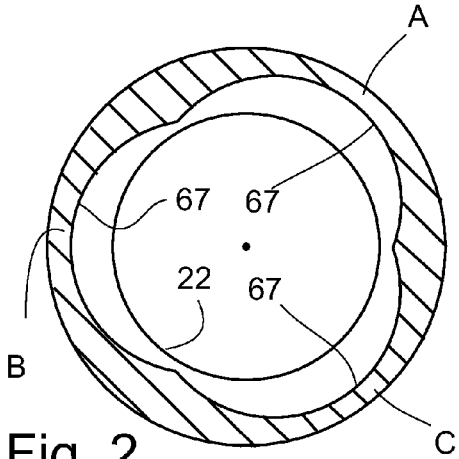
Fig. 2
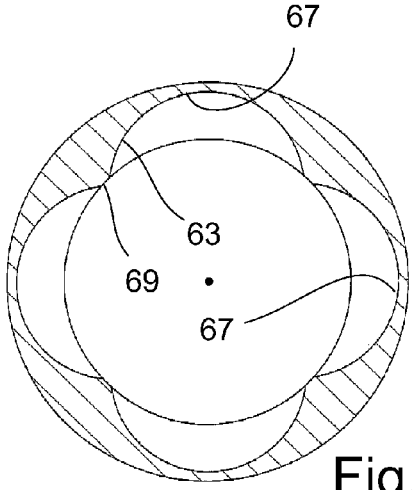
Fig. 3

JAR WITH IMPROVED VALVE

TECHNICAL FIELD

This apparatus relates to jars for downhole use.

BACKGROUND

Various components of conventional drill pipe, coiled tubing or other downhole tools may get stuck in the well bore at times. A jar may be used to deliver jarring blows to a tubing string in order to free a stuck component. Examples of jars include U.S. Pat. Nos. 5,906,239, 5,411,107, 5,495,902, and US patent publication no. 2009-0301707. Many such jars incorporate one or more internal valves that fit closely with a restriction or bowl on the inside of an internal chamber to create a pressure-differential and energy buildup for release in a jarring action.

SUMMARY OF THE DISCLOSURE

These and other aspects of the device and method are set out in the claims, which are incorporated here by reference.

A jar is disclosed comprising: an outer housing; an inner mandrel at least partially disposed telescopically within the outer housing to define a fluid chamber between the inner mandrel and the outer housing, the fluid chamber containing fluid and being sealed; a valve disposed within the fluid chamber, the valve having a restriction surface facing, during setting, a cooperating restriction surface on one of the inner mandrel and the outer housing and a pressure surface facing the other of the inner mandrel and the outer housing, the valve being movable between a seated position in which the valve seats against the other of the inner mandrel and the outer housing and an unseated position; the cooperating restriction surface cooperating with the restriction surface to set the jar for a jar in a first direction; the pressure surface being exposed to fluid within the fluid chamber when the jar is set and pressuring up for a jar in the first direction; the pressure surface being indented to cause uneven radial movement, in a plane perpendicular to a jar axis, of the restriction surface towards the cooperating restriction surface when the jar is set and pressuring up for a jar in the first direction; and jarring surfaces on the inner mandrel and the outer housing respectively for jarring contact with each other during a jar in the first direction.

BRIEF DESCRIPTION OF THE FIGURES

FIG. 1 is a side elevation view, in section, of a valve for a double-acting jar.

FIG. 2 is a cross-sectional view taken along the 2-2 section lines of FIG. 1, illustrating the three indented portions of the valve.

FIG. 3 is a cross-sectional view of an embodiment of a valve with four indented portions.

DETAILED DESCRIPTION

Figure 4:
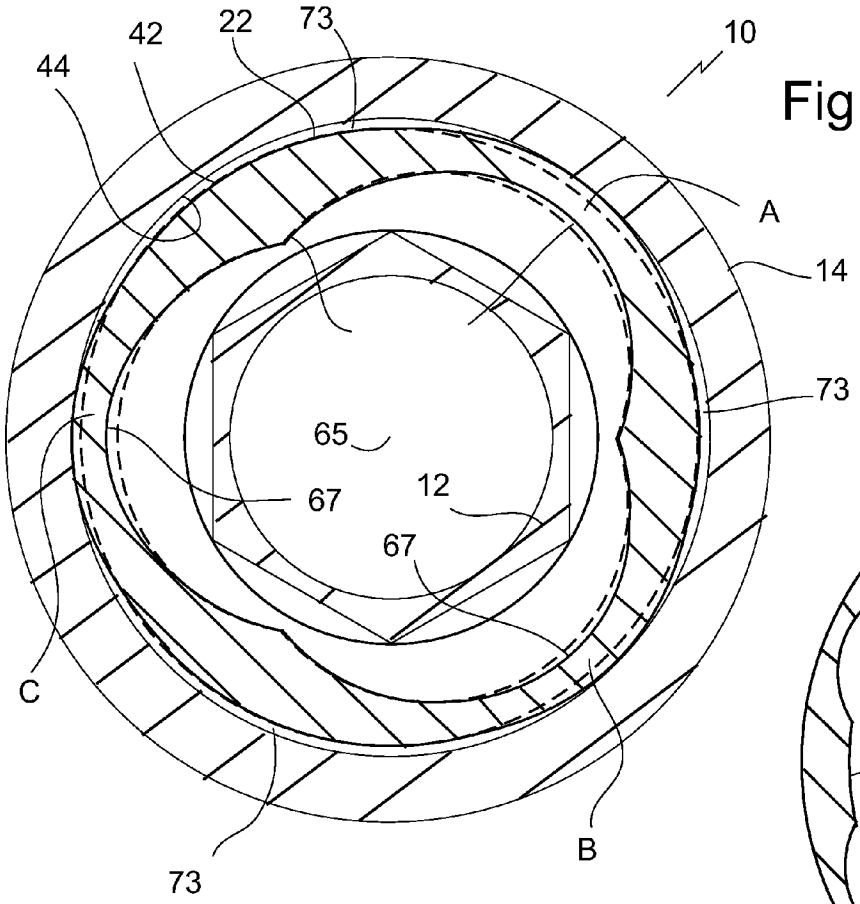
FIG. 4 is a cross-sectional view of the valve of FIG. 2 positioned in a jar and illustrating the uneven expansion under pressure of the restriction surface of the valve. The dashed lines indicate the shape of the valve before expansion, while the solid lines indicate the shape of the valve during expansion.

Immaterial modifications may be made to the embodiments described here without departing from what is covered by the claims. Figures are not drawn to scale.

Various components of conventional drill pipe, coil tubing or other downhole tools get stuck in the well bore at times. Jars are used in the oilfield industry to deliver jarring blows in order to free a stuck component, such as a stuck section of pipe. Jars are also used in fishing operations, in order to free an object stuck in a downhole well. Under these circumstances, repetitive upjarring or downjarring with a jarring tool can be useful. Double-acting jars exist that are capable of performing this function.

Drill jars provide a large transient force impact to a tubing string in either an upward or downward direction. A jar may have an inner mandrel disposed within an outer housing, defining a fluid chamber filled with hydraulic fluid in between the two. The hydraulic fluid may be gas or liquid. A tensile or compressive force is applied, through the tubing string, to either the outer housing or the inner mandrel of the jar, forcing the outer housing and inner mandrel to move relative to one another. The relative movement between the two is initially restricted within the fluid chamber as the jar is set, such that the energy of the tensile or compressive force builds up in the tubing string. As soon as the outer housing and inner mandrel move far enough relative to one another to release, the energy built up in the tubing string is transferred into rapid relative motion between the inner mandrel and the outer housing. Jarring shoulders on both the inner mandrel and outer housing then impact one another, releasing a large amount of kinetic energy into the tubing string and causing a striking blow to the stuck object.

Adapting a jar and compounder assembly to a coil tubing application presents some challenges to overcome. A coil tubing operation may involve a continuous pipe or tubing, which is uncoiled from a reel as it is lowered into the well bore, and can be used in drilling or workover applications for example. However, coil tubing presents a number of working constraints to the design of a tool. First of all, due to the limited strength of the coil tubing, limited compressive loads can be placed on the tubing by the rig operator.

Essentially, this means that downhole tools that require compressive force to operate, such as a jarring tool, must be capable of operating with the limited compressive load capability of coil tubing. In addition, in coil tubing applications the overall length of the downhole tool becomes significant since there is limited distance available at the wellhead, for example between the stuffing box and the blowout preventor, to accommodate the bottom hole assembly. A typical bottom hole assembly may include additional tools, for example, a quick disconnect, a sinker bar, a release tool of some type, and an overshot. Thus, the length of the jar or compounder itself becomes particularly significant since the entire bottom hole assembly may be required to fit within the limited distance between the stuffing box and blowout preventor to introduce it into a pressurized well. Furthermore, within these confines, the jar and compounder assembly may be required to have a large enough internal bore to permit pump-down tools to pass. Thus, coil tubing jar and compounder assemblies may have a limited overall wall thickness in view of limited outer diameter conditions.

Figure 7:
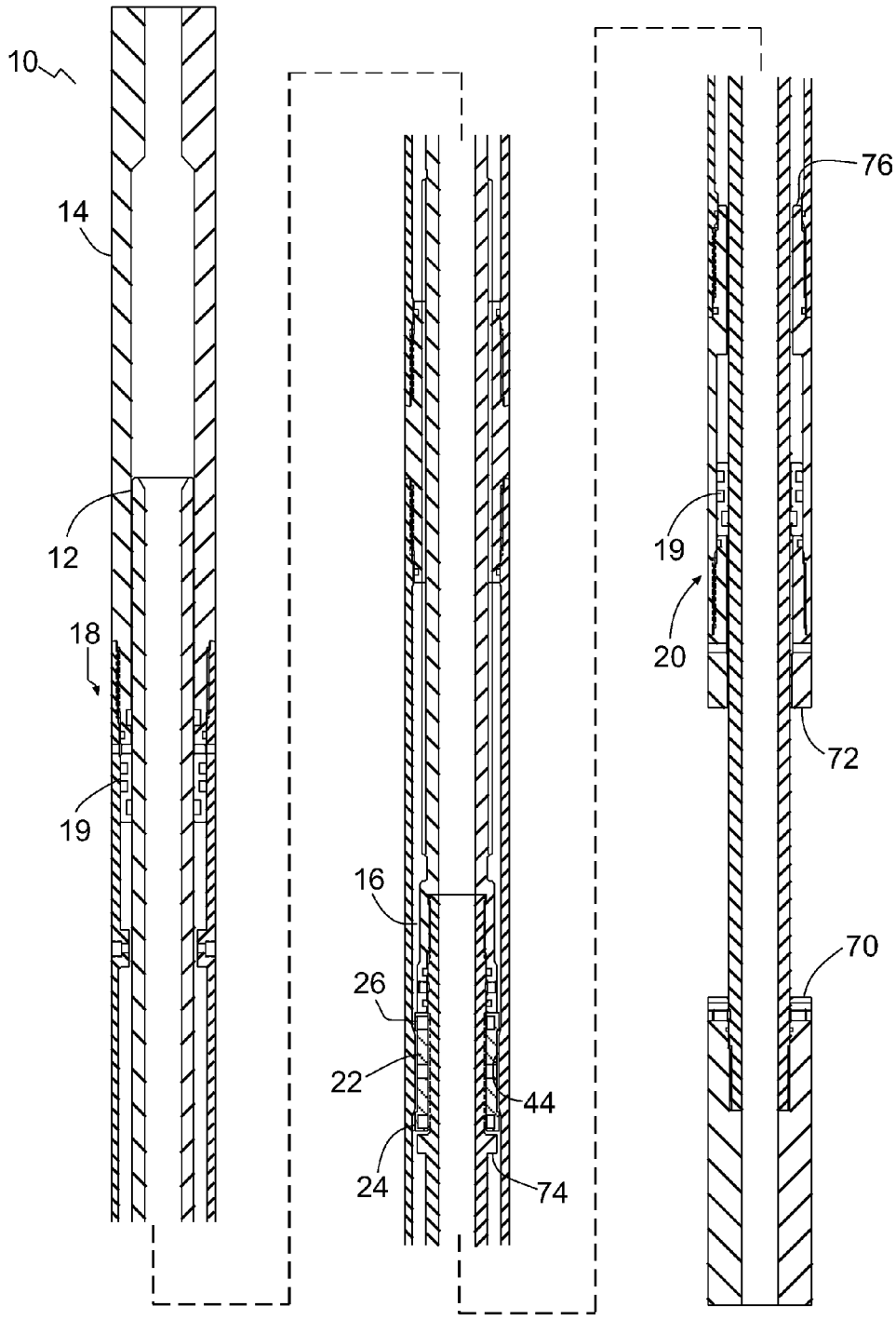
FIG. 7 forms an exploded side elevation view, in section, of a double-acting jar in the neutral position.

Referring to FIG. 7, jar 10 is illustrated, jar 10 being a double-acting jar in the embodiment shown, and comprising an inner mandrel 12 and an outer housing 14. Inner mandrel 12 is at least partially disposed telescopically within outer housing 14 to define a fluid chamber 16 between inner mandrel 12 and outer housing 14. Fluid chamber 16 contains fluid and is sealed for example at an uphole 18 end and a downhole end 20.

Figure 6C:
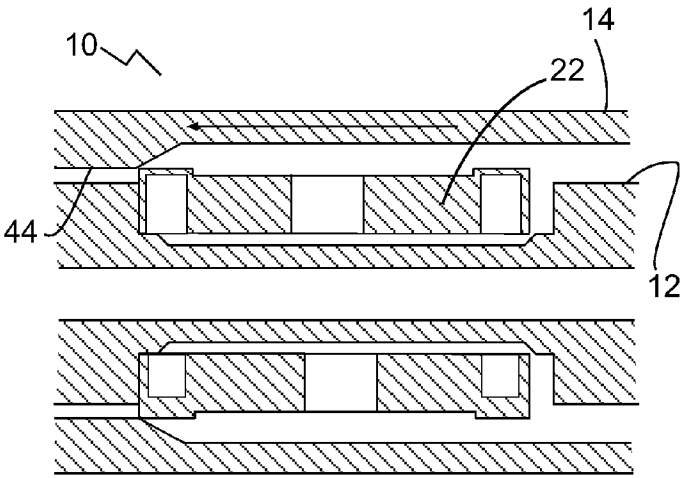
FIGS. 6A-6H are partial side elevation views, in section, illustrating the operation of one embodiment of a double-acting jar performing succeeding jars in both directions.
Figure 6D:
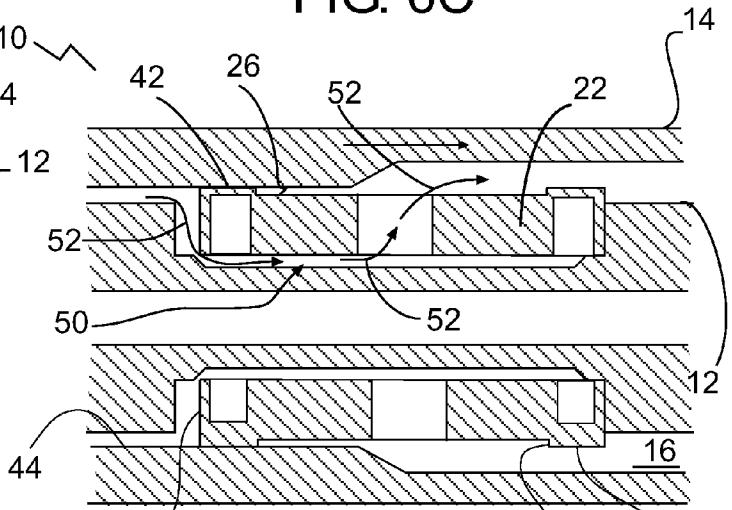
Figure 6A:
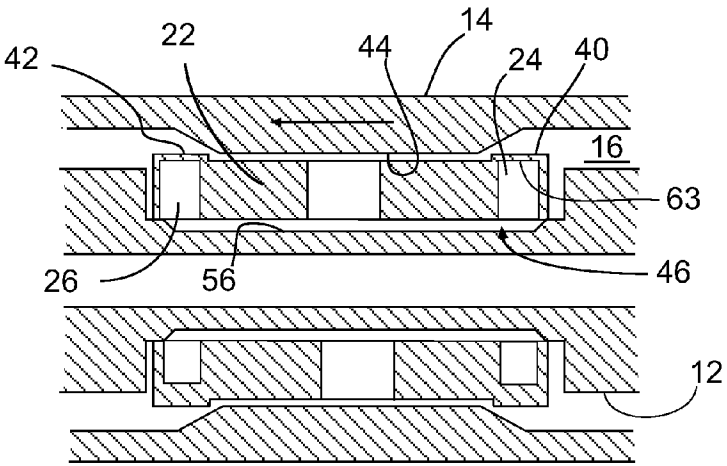

Referring to FIGS. 6A and 7, a valve 22 is disposed within the fluid chamber 16. The valve 22 is shown located on the inner mandrel 12, but valve 22 may be located on the outer housing 14 in some embodiments. The valve 22 may have a downhole portion 24, and an uphole portion 26, for example as shown. Portions 24 and 26 may be provided as part of the same valve as shown.

Figure 6B:
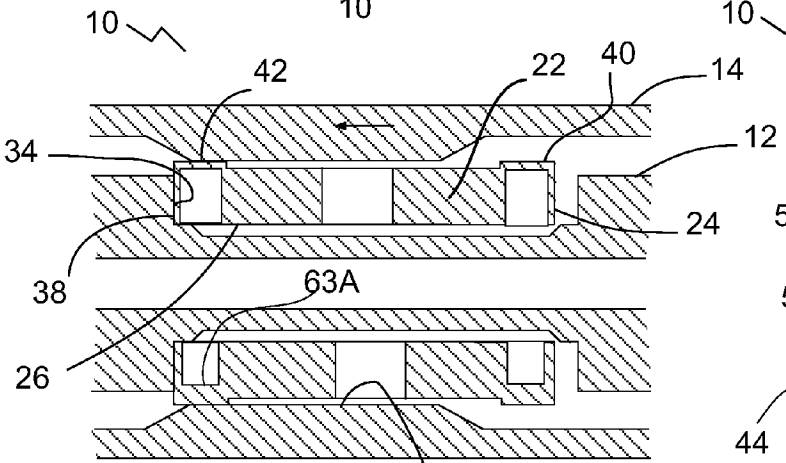
Figure 6G:
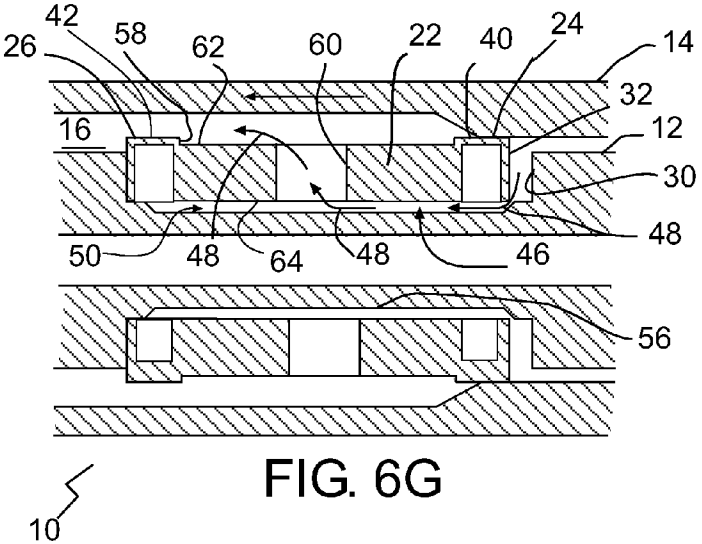
Figure 6H:
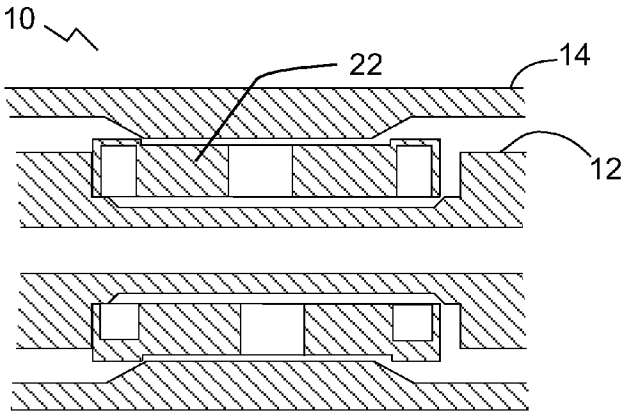
Figure 6E:
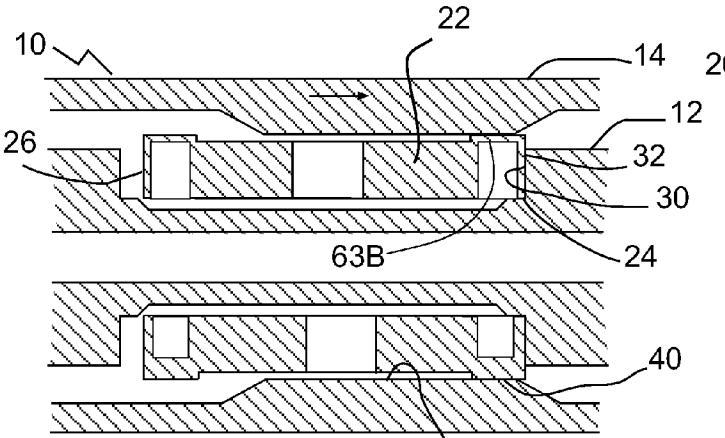

Referring to FIGS. 6A, and 6E, downhole portion 24 may be movable between a downhole seated position (shown in FIG. 6E) in which the valve 22 seats against the inner mandrel 12 for example, and an unseated position (shown in FIG. 6A). Referring to FIGS. 6A, 6B, and 6D, uphole portion 26 may be movable between an uphole seated position (shown in FIG. 6B) in which the valve 22 seats against the inner mandrel 12 for example, and an unseated position (shown in FIGS. 6A and 6D).

Referring to FIG. 6E, jar 10 may use a suitable seating configuration for seating downhole portion 24 and uphole portion 26, for example engagement between an uphole facing seating shoulder 30, and a seating surface 32 of the downhole portion 24. Referring to FIG. 6B, an analogous configuration is illustrated for uphole portion 26, with engagement between a downhole facing seating shoulder 34 and a seating surface 38 of the uphole portion 26. Other seating configurations may be used.

Referring to FIG. 6A, downhole portion 24 may have a downhole restriction surface 40, and uphole portion 26 may have an uphole restriction surface 42. The outer housing 14 may have a cooperating restriction surface 44, which may be referred to as a bowl in some cases, that cooperates with the uphole restriction surface 42 and the downhole restriction surface 40 to set the jar 10 for a jar as will be explained. Setting the jar causes energy in the drill string to build up for jarring release.

Figure 6F:
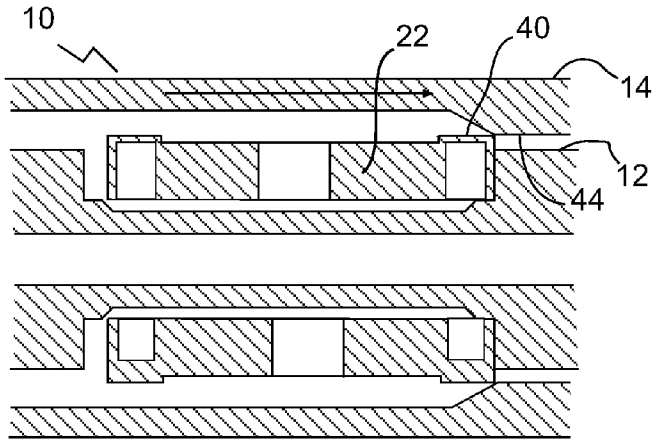

Referring to FIGS. 6C, 6F, and 6A, the cooperating restriction surface 44 may be dimensioned so that, from relative movement of the inner mandrel 12 and the outer housing 14, the cooperating restriction surface 44 is movable from above (shown in FIG. 6C) to below (shown in FIG. 6F) the valve 22. Cooperating restriction surface 44 may have a neutral position (shown in FIG. 6A) in which a portion of the cooperating restriction surface 44 is between the downhole restriction surface 40 and the uphole restriction surface 42. Referring to FIG. 6A, the cooperating restriction surface 44 may be fully between (shown in FIG. 6A) or partially between (not shown) the downhole restriction surface 40 and the uphole restriction surface 42 when in the neutral position.

Referring to FIG. 7, cooperating restriction surface 44 may be spaced from uphole end 18 and downhole end 20 of fluid chamber 16. In the embodiment illustrated in FIG. 7, cooperating restriction surface 44 is located on outer housing 14, with valve 22 on inner mandrel 12, although this orientation may be reversed. For example, cooperating restriction surface 44 may be on the inner mandrel 12, with valve 22 positioned on outer housing 14. Cooperating restriction surface 44 may be, for example, a shoulder, such as an annular shoulder. Cooperating restriction surface 44 may be of a suitable length for sufficiently setting valve 22 for a jar in either direction.

Referring to FIG. 6G, the downhole restriction surface 40 may incorporate a first bypass 46 that is configured to allow bypass of fluid in the chamber 16, for example in the direction of flow lines 48, when the downhole restriction surface 40 and the cooperating restriction surface 44 move past each other during re-setting of the jar 10. Referring to FIG. 6D, the uphole restriction surface 42 may incorporate a second bypass 50 that is configured to allow bypass of fluid in the chamber 16, for example in the direction of flow lines 52, when the uphole restriction surface 42 and the cooperating restriction surface 44 move past each other during re-setting of the jar 10. The first and second bypasses 46 and 50, respectively, may prevent the jar from setting while the cooperating restriction surface 44 is making its way back into the neutral position from a downjar or an upjar, respectively. Thus, the jar 10 may not be limited to performing jars in alternating directions only.

Figure 12A:
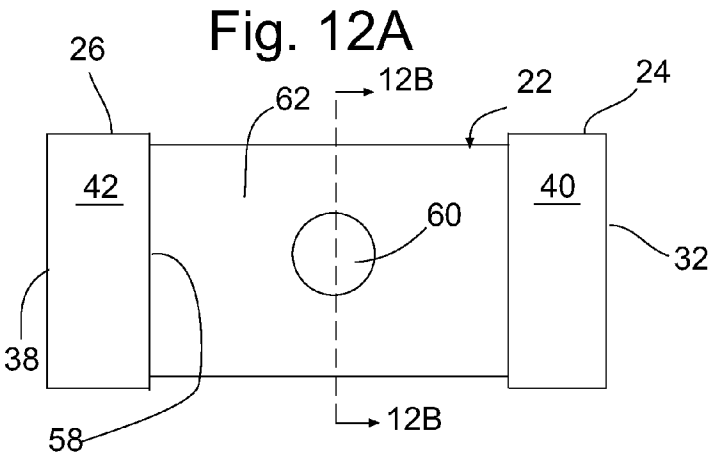
FIG. 12A is a plan view of another embodiment of valve of a double-acting jar.
Figure 12B:
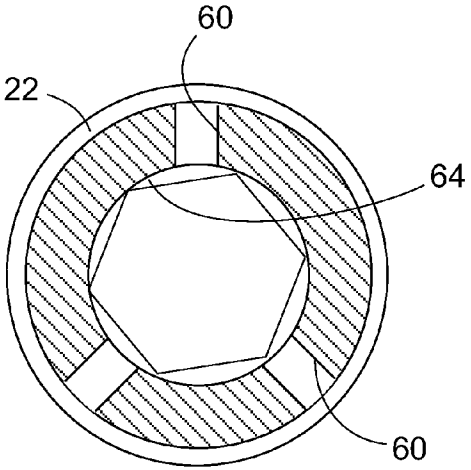
FIG. 12B is a cross-sectional view taken along the 12B-12B lines in FIG. 12A.

Referring to FIG. 6G, the first bypass 46 may be defined by one or more of the downhole portion 24, the inner mandrel 12, and the outer housing 14. Similarly, referring to FIG. 6D the second bypass 50 may be defined by one or more of the uphole portion 26, the inner mandrel 12, and the outer housing 14. Referring to FIGS. 12A-B, the first bypass 46 (shown in FIG. 6G) may be defined from a downhole end 58 of the uphole restriction surface 42 to seating surface 32 of the downhole portion 24. Similarly, the second bypass 50 (shown in FIG. 6D) may be defined from an uphole end 54 of the downhole restriction surface 40 to seating surface 38 of the uphole portion 26. In some embodiments one or more of the first bypass 46 and the second bypass 50 comprise a channel 60 that extends between an outer exterior surface 62 to an inner exterior surface 64 of the valve 22. Referring to 11B and 12B, more than one channel 60 may be provided, for example as shown.

Figure 11A:
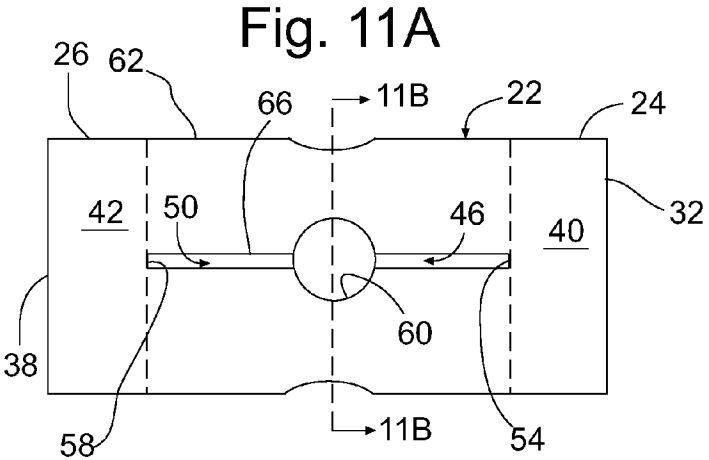
FIG. 11A is a plan view of another embodiment of valve of a double-acting jar. The dashed lines are used to indicate the perimeters of the downhole and uphole restriction surfaces.
Figure 11B:
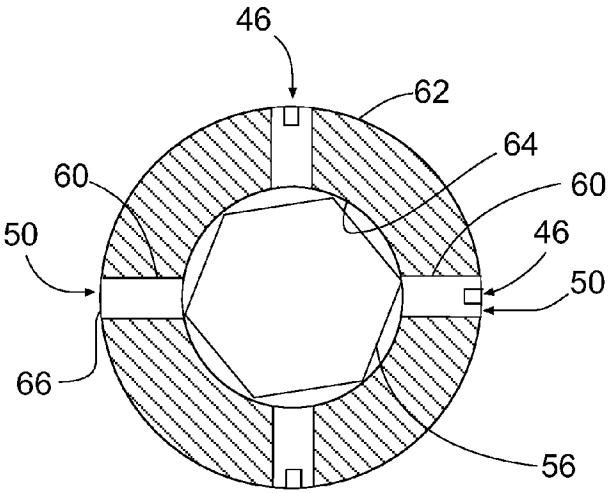
FIG. 11B is a cross-sectional view taken along the 11B-11B lines in FIG. 11A.

Referring to FIGS. 11A and 11B, the first and second bypasses may effectively form flow passages that are exposed and fully defined when the jar is re-setting and the respective uphole or downhole portion that just carried out a jar is unseated. Referring to FIG. 6G, in the embodiment shown the first bypass 46 is defined by seating surface 32, seating shoulder 30, an undercut portion 56 of inner mandrel 12, passage 60, intermediate outer exterior surface 62, and downhole end 58 of uphole restriction surface 26. Referring to FIG. 11B, undercut portion 56 may be defined by a series of flats on the outer surface of inner mandrel 12 as shown. The purpose of undercut portion 56 may be achieved other ways, such as by defining a channel in one or more of inner mandrel 12 or valve 22. Referring to FIG. 11B, in other embodiments the first bypass may be defined similarly, with the exception that instead of intermediate outer exterior surface 62 the first bypass is defined further by a passage 66 in intermediate outer exterior surface 62 to downhole end 58. Passage 66 may be one or more of a reduced thickness section for example, a reduced or increased diameter section, a tapered section, and a slot as shown. Passage 66 may assist restriction surface 42 to properly align within cooperating restriction surface 44 before pressuring up. This may reduce the chance of valve 22 jamming upon attempted setting. Referring to FIG. 12A, an embodiment is illustrated where intermediate outer exterior surface 62 comprises a reduced diameter surface relative to uphole restriction surface 42. It should be understood that second bypass 50 may have the same corresponding characteristics as all embodiments of first bypass 46. Also, plural bypasses may be present.

Referring to FIG. 12A, downhole portion 24 and uphole portion 26 are illustrated as part of the same valve 22. However, in some embodiments downhole portion 24 and uphole portion 26 may be separate valves. Referring to FIGS. 11A and 12A, exemplary embodiments of this may be envisioned by cutting valve 22 in half along the section lines 11B and 12B, respectively. In such embodiments, one or more of an uphole end of downhole portion 24 and a downhole end of uphole portion 26 may define passage 60. A retaining shoulder (not shown) in the fluid chamber may separate portions 24 and 26 in such embodiments.

Figure 8:
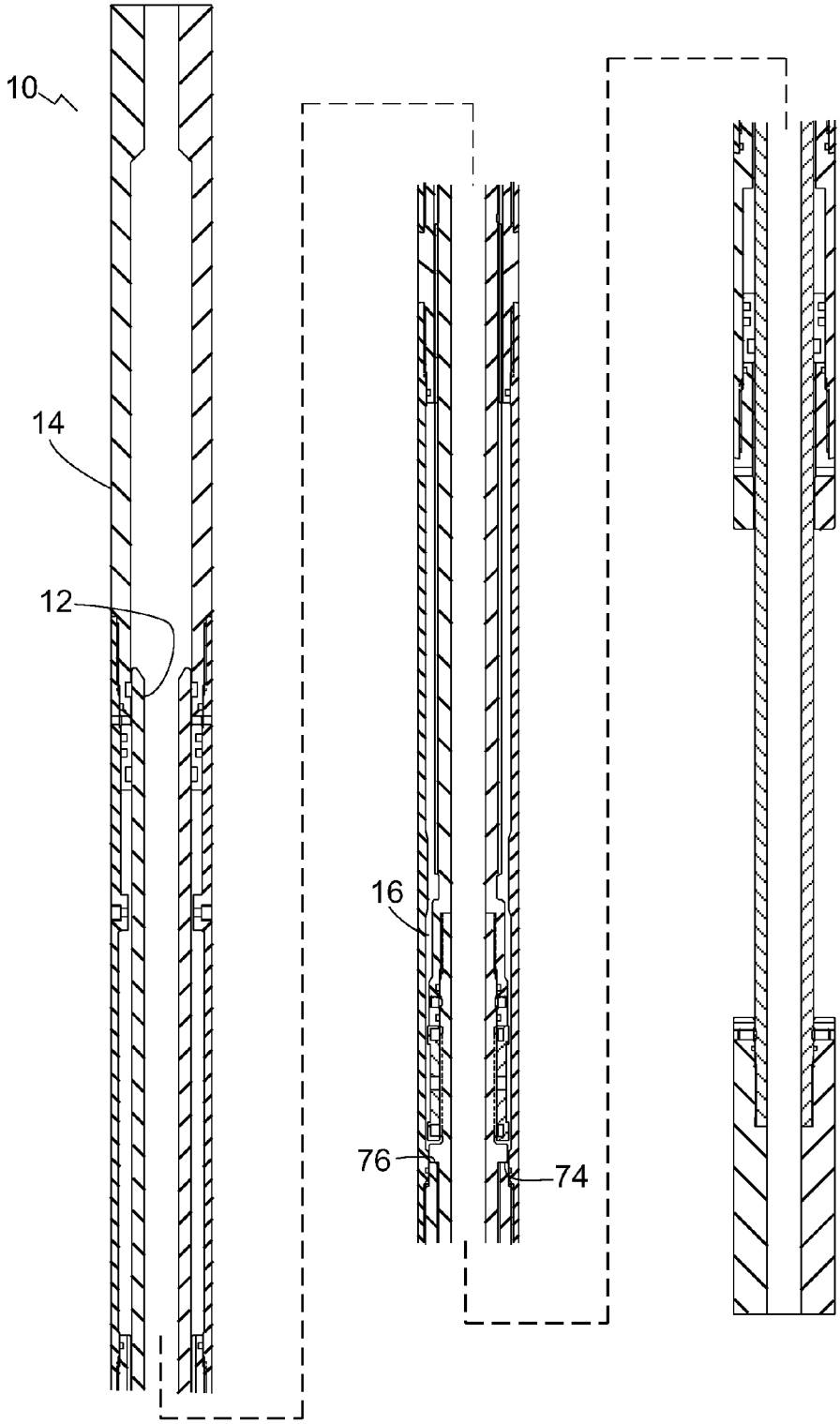
FIG. 8 forms an exploded side elevation view, in section, of the double-acting jar of FIG. 7 jarred fully up.
Figure 9:
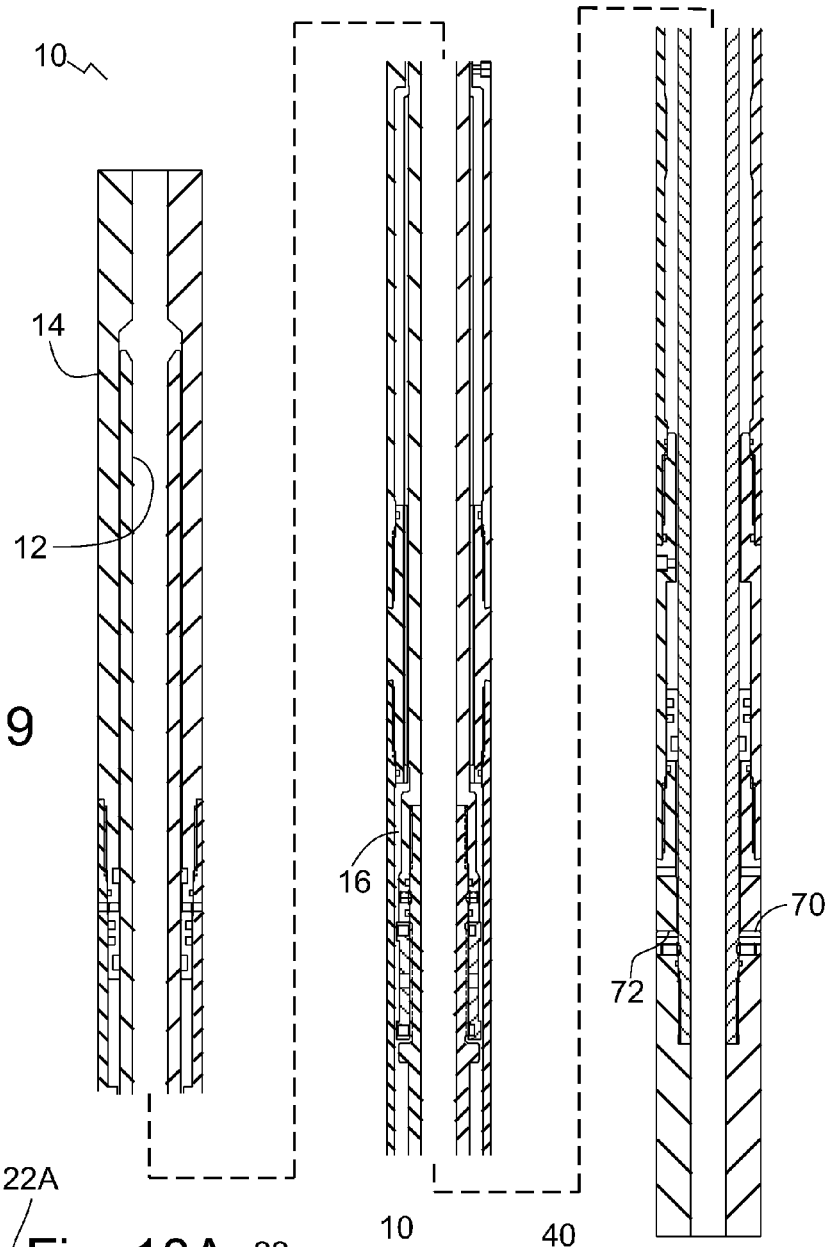
FIG. 9 forms an exploded side elevation view, in section, of the double-acting jar of FIG. 7 jarred fully down.

Referring to FIGS. 7 and 9, jar 10 may have first jarring surfaces 70 and 72 on inner mandrel 12 and outer housing 14, respectively, for jarring contact with each other during a jar in a downhole direction. A downjar stroke is illustrated from FIG. 7 to FIG. 9. Referring to FIGS. 7 and 8, jar 10 may have second jarring surfaces 74 and 76 on inner mandrel 12 and outer housing 14, respectively, for jarring contact with each other during a jar in an uphole direction. An upjar stroke is illustrated from FIG. 7 to FIG. 8. It should be understood that first jarring surfaces 70 and 72, and second jarring surfaces 74 and 76 may be formed at a suitable location on jar 10, such that they are able to collide with one another to release the force of the jarring motion in a striking impact. The jarring surfaces may be positioned within or outside of fluid chamber 16.

Referring to FIGS. 6B and 6E, it should be understood that limited fluid transfer should occur across the valve 22 in order for cooperating restriction surface 44 to be able to move across the seated portion 24 or 26 during setting of the jar. This may be achieved by providing a close tolerance fit between the cooperating restriction surface 44 and the uphole and downhole restriction surfaces 40 and 42. A close tolerance fit may refer to surfaces 40 and 42 being machined to fit cooperating restriction surface 44 with a close tolerance that allows fluid to meter across the valve 22 through the annular gap between cooperating restriction surface 44 and the set of surfaces 40 and 42 during setting and build-up of the pressure differential.

Figure 10A:
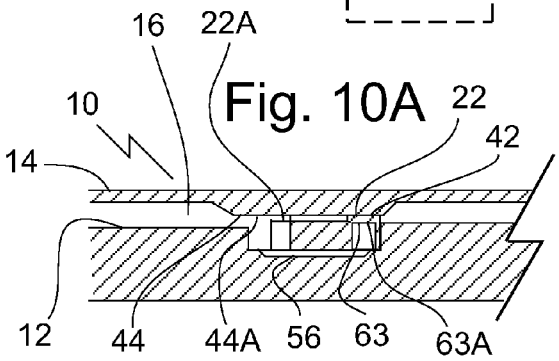
FIGS. 10A and B are side elevation views, in section, of single acting jar valves.
Figure 10B:
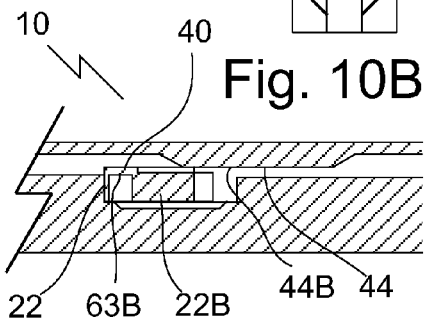

Although the jar 10 is described above in a double-acting jar embodiment with downhole and uphole restriction surfaces 40 and 42, the jar 10 will now be described in more general terms. Referring to FIG. 10A, valve 22 has a restriction surface, for example surface 42 as shown, that faces, during setting, cooperating restriction surface 44 on the outer housing 14. The restriction surface shown in FIG. 10A is described as uphole restriction surface 42, but the same concepts apply to downhole restriction surface 40. In general in this document, where uphole restriction surface 42 is described, the downhole restriction surface 40 may have similar characteristics, and vice versa. Referring to FIGS. 4, and 10A, valve 22 also has a pressure surface 63 facing the inner mandrel 12. Referring to FIG. 10A, valve 22 is movable between a seated position and an unseated position, for example in a fashion similar to that described above for portions 24 or 26. In use, the cooperating restriction surface 44 cooperates with the restriction surface 42 to set the jar for a jar in a first direction, such as an uphole or downhole direction.

Referring to FIG. 10A, as shown, the pressure surface 63 is exposed to fluid within the fluid chamber 16 when the jar 10 is set and pressuring up for a jar in the first direction as shown. As shown, fluid from fluid chamber 16 may communicate with pressure surface 63 through undercut portion 56 of inner mandrel 12. Because valve 22 establishes a pressure differential in chamber 16, the fluid exposed to pressure surface 63 is of a relatively high pressure during setting. Referring to FIG. 4, the pressure surface 63 is indented to cause uneven radial movement of the restriction surface 42 towards the cooperating restriction surface 44 when the jar 10 is set and pressuring up for a jar in the first direction. The uneven radial movement is illustrated by the expansion of valve 22 from an unexpanded position shown in dotted lines to an expanded position shown in solid lines. The uneven movement is illustrated as occurring in a plane perpendicular to a jar axis 65.

Referring to FIG. 4, providing an indented pressure surface 63 underlying restriction surface 42 gives valve 22 varying thickness between surfaces 63 and 42 throughout the plane shown in the figure. Thus, thin sections, such as sections A, B, and C are formed that are adapted to resiliently flex under pressure towards cooperating restriction surface 44 to a greater extent than the rest of the restriction surface 42 shown in the illustrated plane. Providing a valve 22 where restriction surface 42 undergoes uneven radial movement allows jar setting time to be controlled and premature jarring to be avoided. During setting, cooperating restriction surface 44 expands radially outward under the applied fluid pressure. While setting, a conventional jar with a valve wall having a uniform thickness between restriction surface 42 and the underlying interior bore will generally experience one of two possible outcomes. Firstly, if the valve wall is too thick, the restriction surface 42 will not expand sufficiently to compensate for the increased tolerance, resulting in increased fluid metering and premature jarring. Secondly, if the valve wall is too thin, the restriction surface 42 will expand uniformly to contact and seal against cooperating restriction surface 44, effectively locking the jar 10. By contrast, providing an indented pressure surface 63 creates thin sections such as A, B, and C, that are manufactured to expand in a controlled fashion to a greater extent than the corresponding thicker portions along the rest of the circumference of the restriction surface 42. Thus, gaps 73 may be defined between surfaces 42 and 44, gaps maintaining a close tolerance between restriction surface 42 and cooperating restriction surface 44. Gaps 73 allow fluid metering to occur at a controlled rate, and prevent tool lockup and premature release. Thin sections A, B, and C may contact the cooperating restriction surface 44 in use as shown. The dimensions, including the number and size of indented portions 67 may be selected to ensure that the overall cross-sectional area defined by gaps 73 and available for fluid metering during setting is sufficient for a predetermined setting time and pressure.

Figure 5:
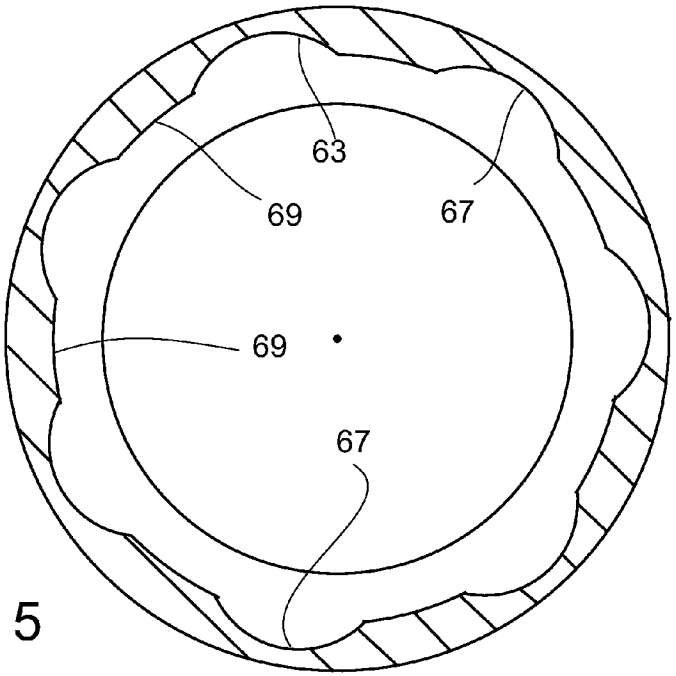
FIG. 5 is a cross-sectional view of another valve for a jar.

The pressure surface 63 is illustrated in FIGS. 2 and 4 as having 3 indented portions 67, although more or less indents may be used to cause the desired effect. For example, FIGS. 3 and 5 illustrate pressure surfaces 63 with four and seven indented portions 67, respectively. As shown, there may be spacings 69 between indented portions 67. Spacings 69 may denote portions of uniform valve wall thickness as shown. As well, Referring to FIG. 4, the pressure surface 63 may be indented with scalloping as shown.

Referring to FIG. 4, the valve 22 is illustrated as being annular, although this is not required. In addition, the orientation of pressure surface 63 and restriction surface 42 may be reversed, for example if valve 22 is mounted on the outer housing 14, the cooperating restriction surface 44 is mounted on the inner mandrel 12, and the pressure surface 63 faces the outer housing 14. In such an embodiment, the pressure surface 63 would cause the restriction surface 42 to unevenly contract under fluid pressure, causing an analogous effect as that described above.

Referring to FIG. 1, the valve 22 or valve system may incorporate plural pressure surfaces for acting in each directions. For discussion purposes of such an embodiment, the downhole restriction surface 40 will be discussed and pressure surface 63 (also shown by reference numeral 63B) is thus located on downhole portion 24. The uphole portion 26 may thus comprise a pressure surface 63A, facing the inner mandrel 12 (shown in FIG. 6A), that is exposed to fluid within the fluid chamber 16 when the jar 10 is set and pressuring up for a jar 10 in the second direction. FIG. 1 illustrates the valve 22 as a single valve for the double acting jar of FIG. 7. However, by combining the valves 22A and 22B of FIGS. 10A and B, respectively, into a single jar, a dual valve embodiment of a double-acting jar is provided. In such a jar 10, the cooperating restriction surface 44 comprises an uphole cooperating restriction surface 44A and a downhole cooperating restriction surface 44B. Downhole cooperating restriction surface 44B cooperates with the downhole restriction surface 40 to set the jar 10 for a jar in the uphole direction. Also, uphole cooperating restriction surface 44A cooperates with the uphole restriction surface 42 to set the jar 10 for a jar in the downhole direction. The positioning of the valves 22A and 22B may be reversed, so that valve 22A is positioned downhole of valve 22B.

In the case of a single acting jar, or a valve 22 for jarring in one direction only, only a single set of jarring surfaces are needed for jarring contact between the inner mandrel 12 and the outer housing 14. Referring to FIG. 7, for a double-acting jar such as the jar 10 illustrated, two sets of jarring surfaces, namely jarring surfaces 70 and 72, and 74 and 76, may be present.

Referring to FIGS. 6A-H, operation of jar 10 during a sequence of an upjar and then a downjar is illustrated. Referring to FIG. 7, the entire jar 10 is illustrated with valve 22 in the neutral position. Referring to FIG. 6A, to carry out an upjar, outer housing 14 is slid from neutral in an uphole direction relative to inner mandrel 12. Referring to FIG. 6B, as soon as cooperating restriction surface 44 moves over an initial portion of uphole restriction surface 42 to bias the uphole portion 26 into the uphole seated position, the jar 10 is set for an upjar and the fluid pressure differential is established across valve 22. The pressure differential restricts the upward relative motion of outer housing 14 over inner mandrel 12 as cooperating restriction surface 44 moves over uphole restriction surface 42, storing potential energy in the drill string. At this point, pressure acting on pressure surface 63A causes uphole restriction surface 42 to unevenly expand to control metering during setting. Referring to FIG. 6C, when cooperating restriction surface 44 clears uphole restriction surface 42, the stored energy is suddenly released and transferred into rapid relative motion of outer housing 14 over inner mandrel 12. Referring to FIG. 8, the rapid motion of outer housing 14 relative to inner mandrel 12 is abruptly halted upon colliding impact between second jarring surfaces 74 and 76 as shown, delivering an upward jarring impact.

Referring to FIG. 6D, jar 10 is then re-set, by relative movement of outer housing 14 in the downhole direction. When cooperating restriction surface 44 reaches and moves across uphole restriction surface 42, second bypass 50 allows fluid bypass to occur across the valve 22, preventing build up of the fluid pressure differential. This allows cooperating restriction surface 44 to return to the neutral position, from which an upjar or a downjar may be carried out as desired.

Referring to FIG. 6E, a downjar is now carried out. Thus, outer housing 14 is slid from neutral in a downhole direction relative to inner mandrel 12. As soon as cooperating restriction surface 44 moves over an initial portion of downhole restriction surface 40 to bias the downhole portion 24 into the downhole seated position, the jar 10 is set for a downjar and the fluid pressure differential is established across valve 22. At this point, pressure acting on pressure surface 63B causes downhole restriction surface 40 to unevenly expand to control metering during setting. The pressure differential restricts the downward relative motion of outer housing 14 over inner mandrel 12 as cooperating restriction surface 44 moves over downhole restriction surface 40, storing potential energy in the drill string. Referring to FIG. 6F, when cooperating restriction surface 44 clears downhole restriction surface 40, the stored energy is suddenly released and transferred into rapid relative motion of outer housing 14 over inner mandrel 12. Referring to FIG. 9, the rapid motion of outer housing 14 relative to inner mandrel 12 is abruptly halted upon colliding impact between first jarring surfaces 70 and 72 as shown, delivering a downward jarring impact.

Referring to FIG. 6G, jar 10 is then re-set, by relative movement of outer housing 14 in the uphole direction. When cooperating restriction surface 44 reaches and moves across downhole restriction surface 40, first bypass 46 allows fluid bypass to occur across the valve 22, preventing build up of the fluid pressure differential. Referring to FIG. 6H, this allows cooperating restriction surface 44 to return to the neutral position, from which an upjar or a downjar may be carried out as desired.

In some embodiments, the valve 22 may be configured so that less energy is required to jar in one direction than in the other direction. For example, the clearance between the downhole restriction surface 40 and the cooperating restriction surface 44 may be selected to be greater than the clearance between the uphole restriction surface 42 and the cooperating restriction surface 44, so that a downjar will require less weight on the drill string to carry out. This may be advantageous, particularly in coiled tubing applications where the compressive strength of the drill string is limited relative to the tensile strength of the drill string.

A double-acting jar may be used with a jar enhancing device (not shown), in order to compound the jarring force of jar 10. A jar enhancing device may be connected, for example, either directly or indirectly above jar 10 in the tubing string. Jar enhancers are useful additions with jar 10, for example, during a coiled tubing jarring operation, because they allow additional force to be built up for a jar, without imposing additional strain on the already limited compressive and tensile stress of the tubing string itself.

Jars 10 of the type disclosed herein may be used in, for example, fishing, drilling, coiled tubing, and conventional threaded tubing, operations. The use of up, down, above, below, uphole, downhole, and directional language in this document illustrates relative motions within jar 10, and are not intended to be limited to vertical motions and motions carried out while jar 10 is positioned downhole. It should be understood that jar 10 may be used in any type of well, including, for example, vertical and deviated wells.

Referring to FIG. 7, fluid chamber 16 may comprise a floating seal 19 at least one of uphole and downhole ends 18 and 20, respectively. Floating seals 19 allow pressure differentials between fluid chamber 16 and outside of jar 10 to equalize, which may prevent a fluid chamber 16 from collapsing under extreme fluid pressures such as those experienced downhole.

Referring to FIG. 7, fluid chamber 16 need not be annular in shape. In some embodiments, there may be one or more fluid chambers 16, each one operating according to the embodiments disclosed herein for jarring operation. Plural valves 22, and plural restriction surfaces 44 may also be employed. Either or both of inner mandrel 12 and outer housing 14 may be individually composed of, for example, one or more units connected together. Each unit may be, for example, threaded together as is illustrated in the figures. Outer housing 14 and inner mandrel 12 may be, for example, tubulars. In the embodiment illustrated in FIG. 7, in a downhole application, outer housing 14 may be connected, directly or indirectly, to a tubing string (not shown), whereas inner mandrel 12 may be connected, directly or indirectly, to, for example, a fishing tool (not shown). In some embodiments, this orientation is reversed. It should be understood that jar 10 can be oriented upside down in a well, and still carry out the intended function of the jar. In addition, valve 22 may be positioned on outer housing 14 in the reverse orientation.

As indicated above, the double acting jars disclosed herein may be advantageous for coiled tubing operations, because such jars are adapted to deliver powerful jarring blows in repetitive or sequential uphole and downhole directions, within a tool length that may be much shorter than other double-acting jars, which incorporate multiple valves and restrictions. Referring to FIG. 1, a suitable positioning mechanism, such as different inner diameters 90 and 92 on the inner bore of valve 22 may be provided to match with corresponding outer diameters (not shown) of inner mandrel 12 to prevent reverse installation of valve 22 on the mandrel 12

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A jar comprising:

an outer housing;

an inner mandrel at least partially disposed telescopically within the outer housing to define a fluid chamber between the inner mandrel and the outer housing, the fluid chamber containing fluid and being sealed;

a valve disposed within the fluid chamber, the valve having a restriction surface facing, during setting, a cooperating restriction surface on one of the inner mandrel and the outer housing and a pressure surface facing the other of the inner mandrel and the outer housing, the valve being movable between a seated position in which the valve seats against the other of the inner mandrel and the outer housing and an unseated position;

the cooperating restriction surface cooperating with the restriction surface to set the jar for a jar in a first direction;

the pressure surface being exposed to fluid within the fluid chamber when the jar is set and pressuring up for a jar in the first direction;

the pressure surface being indented to cause uneven radial movement, in a plane perpendicular to a jar axis, of the restriction surface towards the cooperating restriction surface, to define fluid metering gaps between peaks on the restriction surface, when the jar is set and pressuring up for a jar in the first direction, the fluid metering gaps being sized to control a metering rate between a downhole end and an uphole end of the restriction surface; and jarring surfaces on the inner mandrel and the outer housing respectively for jarring contact with each other during a jar in the first direction.

2. The jar of claim 1 in which the pressure surface is indented with scalloping.

3. The jar of claim 1 in which the valve is annular.

4. The jar of claim 1 in which the cooperating restriction surface is on the outer housing and the pressure surface facing the inner mandrel.

5. The jar of claim 1 is a double-acting jar in which:

the valve comprises a downhole portion that is movable between a downhole seated position and an unseated position, the cooperating restriction surface cooperating with a downhole restriction surface of the downhole portion to set the jar for a jar in a downhole direction;

the valve comprises an uphole portion that is movable between an uphole seated position and an unseated position, the cooperating restriction surface cooperating with an uphole restriction surface of the uphole portion to set the jar for a jar in an uphole direction;

the jar further comprises jarring surfaces on the inner mandrel and outer housing respectively for jarring contact with each other during a jar in a second direction; and the restriction surface is either the uphole restriction surface or the downhole restriction surface.

6. The jar of claim 5 in which:

the restriction surface is the downhole restriction surface; and the uphole portion comprises a pressure surface, facing the other of the inner mandrel and the outer housing, that is exposed to fluid within the fluid chamber when the jar is set and pressuring up for a jar in the second direction.

7. The jar of claim 5 in which the downhole portion and the uphole portion are separate valves or are part of the same valve.

8. The jar of claim 5 in which:

the cooperating restriction surface is dimensioned so that, from relative movement of the inner mandrel and the outer housing, the cooperating restriction surface is movable from above to below the valve with a neutral position in which a portion of the cooperating restriction surface is between the downhole restriction surface and the uphole restriction surface;

the downhole restriction surface incorporates a first bypass configured to allow bypass of fluid in the fluid chamber when the downhole restriction surface and the cooperating restriction surface move past each other during re-setting of the jar to the neutral position; and the uphole restriction surface incorporates a second bypass configured to allow bypass of fluid in the fluid chamber when the uphole restriction surface and the cooperating restriction surface move past each other during re-setting of the jar to the neutral position.

9. The jar of claim 5 in which the cooperating restriction surface further comprises:

a downhole cooperating restriction surface cooperating with the downhole restriction surface to set the jar for a jar in one of the first direction or second direction; and an uphole cooperating restriction surface cooperating with the uphole restriction surface to set the jar for a jar in the other of the first direction or second direction.

10. The jar of claim 1 used in a fishing operation.

11. The jar of claim 1 used with coiled tubing.

* * * * *